United States Patent [19]

Shinohara

[11] Patent Number: 4,497,032

[45] Date of Patent: Jan. 29, 1985

[54] VOCAL INDICATING DEVICE OF COPYING MACHINE

[75] Inventor: Tatsuoki Shinohara, Kanagawa, Japan

[73] Assignee: Fuji Xerox Co., Ltd., Tokyo, Japan

[21] Appl. No.: 399,588

[22] Filed: Jul. 19, 1982

[30] Foreign Application Priority Data

Jul. 22, 1981 [JP] Japan ..... 56-113639

[51] Int. Cl.[3] ..... G10L 1/00

[52] U.S. Cl. ..... 364/513.5; 381/51; 355/14 C

[58] Field of Search ..... 381/51–53; 364/424, 513.5; 355/14 C

[56] References Cited

U.S. PATENT DOCUMENTS 4,419,730 12/1983 Ito et al. ..... 364/424

4,459,673 7/1984 Shibazaki et al. ..... 381/51

*Primary Examiner*—E. S. Matt Kemeny

*Attorney, Agent, or Firm*—Sughrue, Mion, Zinn, Macpeak and Seas

[57] ABSTRACT

A vocal indicating device for a copying machine includes a speech synthesizer which says "Please wait a minute" if logic-control circuitry detects the machine in Wait-Mode (e.g., warmup) for more than 5 seconds.

4 Claims, 2 Drawing Figures

VOCAL INDICATING DEVICE OF COPYING MACHINE

BACKGROUND OF THE INVENTION

The present invention relates to a vocal indicating device for a copying machine, which informs an operator of the conditions of the copying machine by the use of voice.

Hitherto, when the fixing temperature decreases, a copying machine is placed in the wait-condition and a copy is not made. For this reason, it has been suggested that the wait-condition be vocally transmitted to the operator. But this information is meaningless and also the cause of noise when given for each waiting mode regardless of duration.

SUMMARY OF THE INVENTION

An object of the present invention is to eliminate the above disadvantage. In accordance with the invention, only in the case where the wait-condition continues for more than a predetermined time, the condition is relayed by the vocal indication "please wait for just a minute". When the wait-condition is released, the next indication "copy OK" is also vocally indicated.

DETAILED DESCRIPTION OF THE PREFERRED EMBODIMENT

Figure 1:
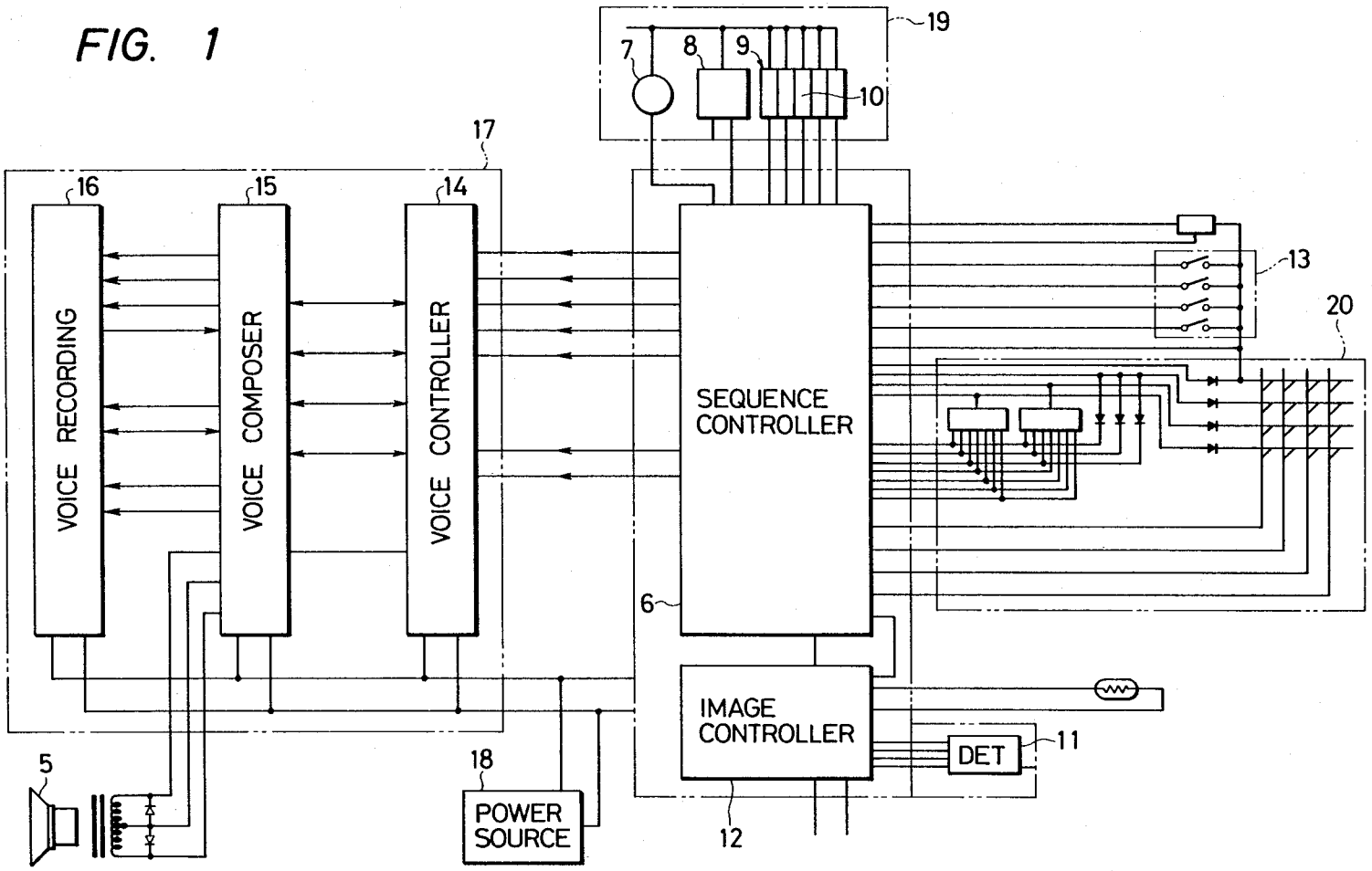
FIG. 1 is a block diagram illustrating one embodiment of the present invention.

Referring to FIG. 1, a controlling system for controlling each part of a copying machine (not shown) and a circuit diagram of a voice output circuit 17 are illustrated. The controlling system includes a sequence controlling circuit 6, a group of operational switches and display units (20) provided on an operational panel for inputting several types of data into the sequence controlling ciruit 6 and for displaying the operational switches being actuated, an image forming unit 19 having a driver 7 for a photo-sensitive member, a high voltage power source 8, a developing device 9, and an optical driving device 10, and an image controlling circuit 12 for controlling a paper feeding device upon detection of the operating conditions of the elements of the image forming unit 19 by means of a detector 11 provided in association with the elements of the image forming unit 19. The image forming unit 19 and the image controlling circuit 12 are controlled by the sequence controlling circuit 6. Sensors 13 are provided in the several parts of the copying machine for detecting the machine's operating condition and supply data of the operating condition of each part of the copying machine with the sequence controlling circuit 6. Reference numeral 18 designates a power source for enabling the controlling system and the voice output circuit 17.

The voice output circuit 17 includes a voice controller 14, a voice composing element 15 and a voice recording element 16. The voice output circuit 17 is known as a PARCOR type voice composer LSI manufactured, for example, by Mitsubishi Denki Kabushiki Kaisha, in which a speech synthesizer 58817AP is used for the voice composing element and phase ROMs #1 and #16 of the type M58818-XXXP are used for the voice recording element 16. The following vocal indicating method is used to inform the operator of the condition of the machine by means of speaker 5.

Figure 2:
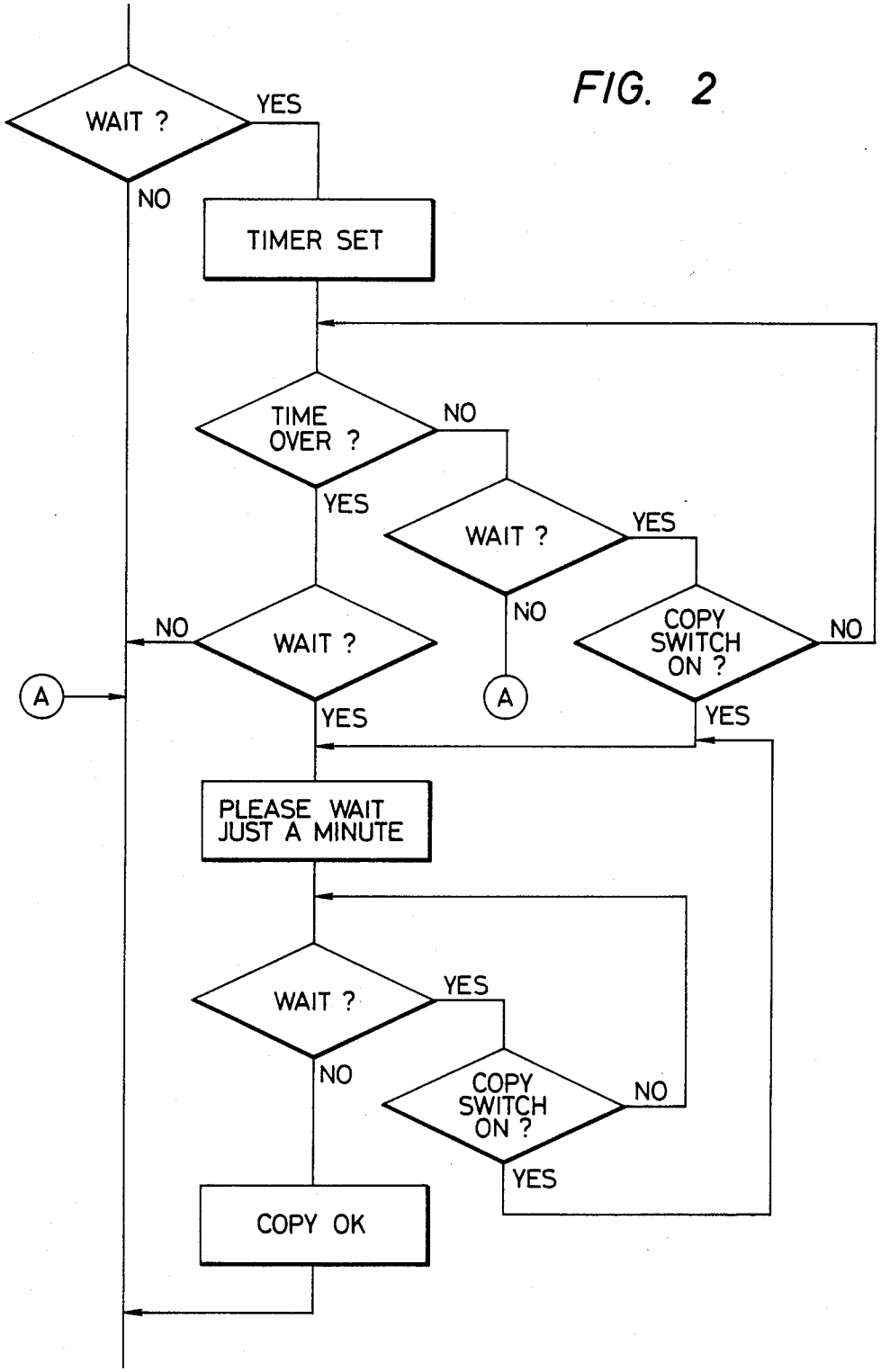
FIG. 2 is a flow chart for illustrating the operating sequence of the invention.

Firstly, a power switch (not shown) is turned ON. If the copying machine is in the wait-condition, a timer (not shown) in the sequence control circuit 6 is set for 5–10 seconds (see FIG. 2). After this 5–10 second period passes, if the wait-condition has ended, noindication is given. If the wait-condition persists, the voice composing element 15 provides a signal from the voice recording element 16 such as "Please wait just a minute" for the speaker 5. Thereafter when the wait-condition is released, a "Copy OK" indication is given through the speaker 5.

Also, when the wait-condition is released before the above set time has expired, no indication is given. But when a copy start switch (not shown) is turn ON before the end of the set time, operation condition advances from the "Copy start switch ON?" step to give the vocal indication "Please wait just a minute". When the wait-condition is ended, the "Copy OK" indication is vocally indicated. A similar operation is performed upon the actuation of the copy switch after a "Wait" vocal indication has already been broadcast.

As is apparent from the above, only when the wait-condition continues for more that the set time, is a "Wait" instruction indicated by voice, and when the wait-condition is released, the next indication is then given by voice, which prevents unnecessary use of the vocal instruction and properly indicates the condition of the copier.

What is claimed is:

1. A vocal indicating device for a copying apparatus including a power switch and a copy start switch, comprising means for detecting an operating condition of parts of said apparatus, said detecting means outputting signals indicative of a waiting mode or a ready mode of said copying apparatus, voice output control means, and control means receiving said signals outputted from said detecting means for controlling the operation of said voice output control means, said control means including timer means set to a predetermined time upon detection of both an operation of said power switch and signals indicative of said waiting mode and actuating said voice output control means at the end of said predetermined time to output a wait indication when said waiting mode continues over said predetermined time.

2. An indicating device as claimed in claim 1, said voice output control means outputting a vocal ready indication upon the end of said waiting mode.

3. An indicating device as claimed in claim 2, said control means actuating said voice output control means to output said wait indication prior to the end of said predetermined time in response to an operation of said copy start switch during said waiting mode and before the end of said predetermined time.

4. An indicating device as claimed in claim 3, said control means actuating said voice output control means to output said wait indication subsequent to a first output of said wait indication in response to an operation of said power switch during said waiting mode and after said first output of said wait indication.

* * * * *